US006409176B2

(12) United States Patent
Allen

(10) Patent No.: US 6,409,176 B2
(45) **Date of Patent: *Jun. 25, 2002**

(54) WELLHEAD HOUSING SEAL ASSEMBLY WITH BACKUP FEATURE

(75) Inventor: Timothy J. Allen, Houston, TX (US)

(73) Assignee: Cooper Cameron Corporation, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,379

(22) Filed: Oct. 5, 1998

(51) Int. Cl.[7] ..... E21B 33/128; F16L 17/06; F16L 55/00

(52) U.S. Cl. ..... 277/340; 277/336; 277/614; 285/15; 285/341

(58) Field of Search ..... 277/340, 338, 277/337, 336, 614; 285/341, 339, 917, 15

(56) References Cited

U.S. PATENT DOCUMENTS

| | | | | |
|---|---|---|---|---|
| 3,507,506 A | | 4/1970 | Tillman, III | |
| 3,556,568 A | | 1/1971 | King | |
| 3,749,426 A | | 7/1973 | Tillman, III | |
| 4,214,763 A | | 7/1980 | Latham | |
| 4,474,381 A | | 10/1984 | Wilkins et al. | |
| 4,563,025 A | | 1/1986 | Poe | |
| 4,709,933 A | | 12/1987 | Adamek et al. | |
| 5,103,915 A | * | 4/1992 | Sweeney et al. | 277/167.5 |
| 5,687,794 A | | 11/1997 | Watkins et al. | |
| 6,007,111 A | * | 12/1999 | Wafer | 277/593 |

* cited by examiner

*Primary Examiner*—Anthony Knight
*Assistant Examiner*—Enoch Peavey
(74) *Attorney, Agent, or Firm*—Peter A. Bielinski; Michael P. Hartmann

(57) ABSTRACT

A tubular connection, an example of which is a subsea wellhead having a primary and secondary seal areas allows the use of a backup or contingency gasket for engagement with the secondary seal area in the wellhead should a failure occur in the primary seal area. In the preferred embodiment, the primary and secondary seal areas are sufficiently separated such that the erosion damage which occurs from leakage with the original gasket adjacent the primary seal area, which can spread below the primary seal area, leaves the secondary seal area unaffected. A backup or contingency gasket can be inserted for sealable contact with the secondary sealing area for further well operations.

31 Claims, 6 Drawing Sheets

WELLHEAD HOUSING SEAL ASSEMBLY WITH BACKUP FEATURE

FIELD OF THE INVENTION

The field of this invention relates in general to tubular joints, particularly subsea wellhead housings and wellhead connectors, and in particular to a seal assembly that provides sealing if the wellhead housing conical sealing surface becomes damaged.

BACKGROUND OF THE INVENTION

A subsea well has a wellhead housing located at the subsea floor. The wellhead housing is a tubular member having a bore. A wellhead connector is lowered from a vessel at the surface over the wellhead housing to connect the subsea well to the surface. The wellhead connector has a connection for connecting to the exterior of the wellhead housing. Thus, a wellhead is one specific type of a tubular joint which is often used in the oilfield.

The wellhead housing has an upward-facing shoulder on its upper end that is engaged by a downward-facing shoulder on the lower end of the wellhead connector. The wellhead housing has a conical upward-facing shoulder at its upper end. The wellhead connector has a conical downward-facing shoulder. The wellhead connector also has a recess located radially inward from the downward-facing shoulder.

A metal seal locates between the wellhead connector and the wellhead housing. The metal seal has a conical upper surface that seals against the conical surface of the wellhead connector. The metal seal has a lower conical surface that seals against the conical surface of the wellhead housing. A rib extends radially outward from the two conical surfaces for location in the recess.

While the metal seal works well, if the conical surface of the wellhead housing becomes damaged, problems occur. The metal seal will not seal against the damaged lower surface. The wellhead housing is cemented in the ground and connected to casing and conductor pipe. It is not possible to pull the wellhead housing from the subsea floor for redressing the conical sealing surface.

A prior design for addressing this problem are illustrated in U.S. Pat. No. 5,103,915. In this design, the subsea wellhead housing has a secondary sealing surface machined below its conical primary sealing surface during manufacturing. The secondary sealing surface extends downward and is of a greater diameter than the bore. A conventional metal seal locates between the wellhead housing and the wellhead connector. The conventional seal seals against the primary sealing surface of the wellhead housing. The secondary sealing surface is not used so long as the wellhead housing primary sealing surface is in good condition. If the wellhead housing primary sealing surface becomes damaged, then a second seal ring is utilized in lieu of the first seal ring. The second seal ring has a support surface that leads to a secondary surface. The secondary surface is cylindrical and is sized to seal against the secondary surface in the wellhead housing. The support surface on the second seal ring is sized so that it will be spaced by a slight gap from the damaged primary sealing surface of the wellhead housing. This prior art device claims that a good seal between the wellhead housing and the wellhead connector can be maintained without need to redress the wellhead housing primary sealing surface. In another embodiment, the secondary seal surface is disclosed as being conical rather than cylindrical and at a lesser angle relative to vertical than the primary sealing surface. This configuration provides for a primary conical sealing surface at one angle, leading into a secondary conical sealing surface at another angle.

The different configurations of the design just described are illustrated in FIGS. 2 and 4 of U.S. Pat. No. 5,103,915. The main problem with this design is that the primary sealing surface, when it fails, is usually eroded due to the velocity effects of leaking fluid. These erosive effects attack not only the primary sealing surface but also the adjacent secondary sealing surface which, looking in the direction of the leaking fluid, presents itself first so that the erosive effects wind up damaging not only the primary but the secondary sealing surfaces in the wellhead. Thus, in effect, the design depicted in U.S. Pat. No. 5,103,915 is not serviceable, even with a replacement gasket, since the secondary surface has irregularities from the erosive effects and can no longer create a seal with the gasket against the connector. This phenomenon is illustrated in FIGS. 1–3 of the present application which depict a prior design akin to that shown in U.S. Pat. No. 5,103,915. Referring to FIG. 1 of this application, the wellhead 10 is shown having a single sealing surface 12, which is tapered. Gasket 14 has a matching taper 16 so that it can be squeezed against the sealing surface 12 by the connector 18. A clamp, generally referred to as 20 and which is of a known design, secures the wellhead 10 to the connector 18 and at the same time, forcing the connector 18 down against the gasket 14 to press the tapered surface 16 of the gasket 14 hard against the sealing surface 12 on the wellhead. In this design, the internal pressure in bore 22 can over time develop a leakpath which begins adjacent the lower end 24 of the gasket 14 in the transition area between bore 22 and tapered surface 16. As fluid under pressure begins to escape past the gasket 14, it begins to erode away part of the tapered sealing surface 12 and, in the configuration of FIG. 1, portions of the wall defining bore 22.

An alternative known prior art design is illustrated in U.S. Pat. No. 5,103,915 and shown in FIGS. 2 and 3 of this application. In FIG. 2, the original gasket 26 is shown with its tapered surface 28 firmly against the tapered sealing surface 30 on the wellhead 32. As before, the connector 34 is clamped by clamp 36 to hold tapered surface 28 against the sealing surface 30 of wellhead 32. Sealing surface 30 is set to be the primary sealing surface, while an adjacent surface 38, which can be cylindrical or tapered, extends immediately below the primary sealing surface 30. During normal operations with an effective seal being formed between surfaces 28 and 30, the gasket 26 is not in contact with the secondary sealing surface 38. The intention of this design is to make use of secondary sealing surface 38 should leakage occur past sealing surface 30. The problem occurs when erosion damage, 20 which is shown in FIG. 3, begins near the lower end 40 of the primary sealing surface 30. As indicated by the cross-hatched area 42 in FIG. 3, the erosive effects spread to a significant portion of the secondary sealing surface 38. Thus, when an oversized replacement gasket, which extends further downwardly with the intent of sealing against the secondary surface 38 is installed in the wellhead 32, the result is unsatisfactory as the hoped for sealing surface 38 has been damaged by the fluid velocity leaking past gasket 26 at surface 30. Thus, the problem with the design shown in FIGS. 2 and 3 of this application is that the secondary sealing surface 38 is configured so that it is in harm's way when the erosive effects of a leak begin. It, therefore, is not available as a smooth surface necessary to get reliable sealing with a replacement gasket made to bridge the damaged primary sealing surface 30 and further designed to seal up against the secondary sealing surface 38 which, at this time, is not serviceable.

Accordingly, it is an object of the present invention to configure a tubular connection, one example of which could be a wellhead, internally, so that in the event leakage past a gasket occurs, the secondary sealing surface is available for use in a serviceable condition, thereby allowing the leak to be repaired, despite the damage to the primary sealing area. By virtue of the proper configuration between the secondary and primary sealing surfaces, the configuration of the present invention allows for reliable use of a secondary or backup sealing surface in conjunction with a backup or contingency gasket configured to reach the secondary sealing surface. The conforming shape of the contingency gasket to the wellhead configuration is also one of the novel inventions disclosed.

Other related wellhead designs of the prior art are disclosed in U.S. Pat. Nos. 5,687,794; 5,039,140; 4,709,933; 4,563,025; 4,474,381; 4,214,763; 3,749,426; 3,556,568; and 3,507,506.

Those skilled in the art will better appreciate the scope of the present invention from a review of the description of the preferred embodiment below.

SUMMARY OF THE INVENTION

A tubular connection, an example of which is a subsea wellhead having a primary and secondary seal areas allows the use of a backup or contingency gasket for engagement with the secondary seal area in the wellhead should a failure occur in the primary seal area. In the preferred embodiment, the primary and secondary seal areas are sufficiently separated such that the erosion damage which occurs from leakage with the original gasket adjacent the primary seal area, which can spread below the primary seal area, leaves the secondary seal area unaffected. A backup or contingency gasket can be inserted for sealable contact with the secondary sealing area for further well operations.

DETAILED DESCRIPTION OF THE PREFERRED EMBODIMENT

Figure 1:
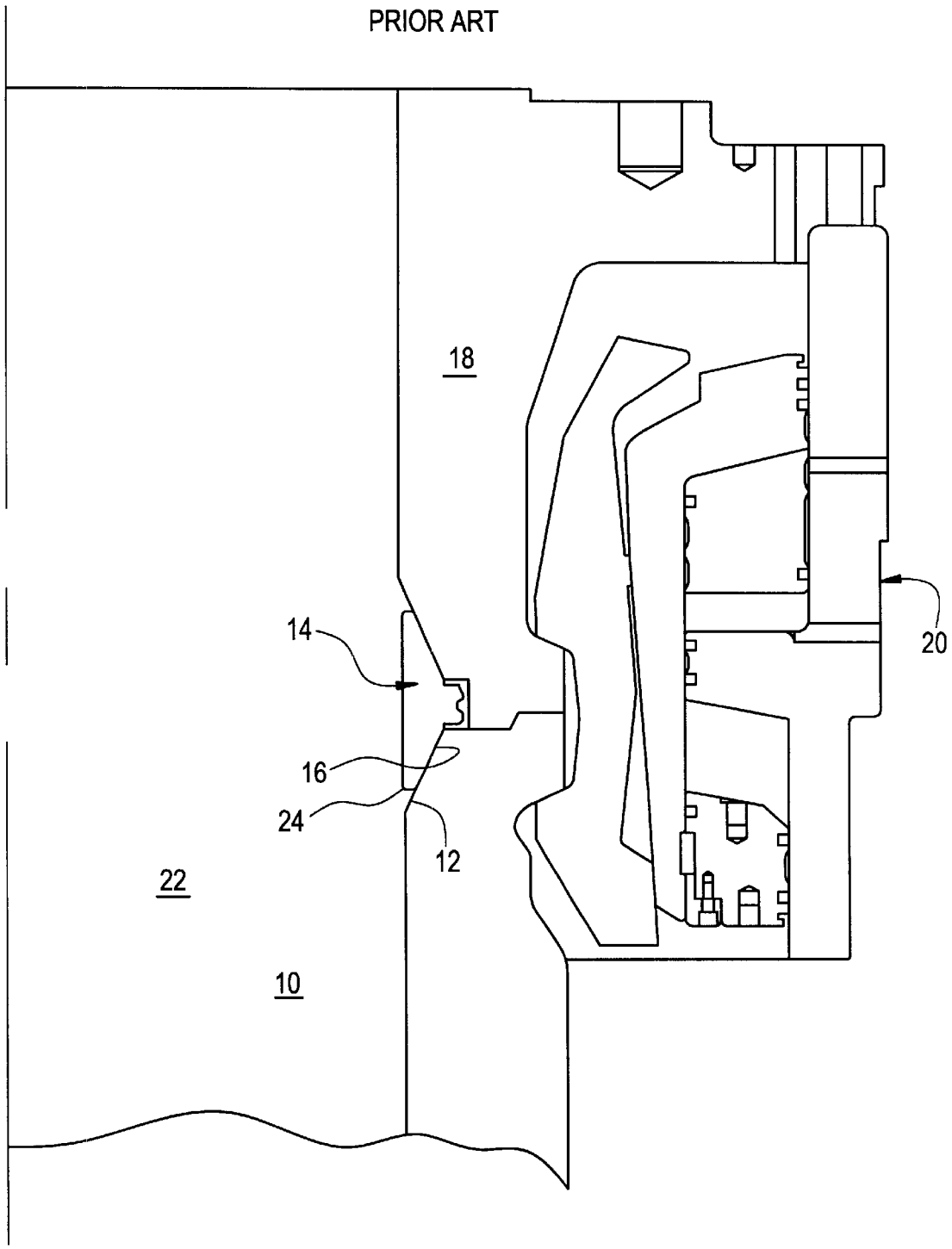
FIG. 1 PRIOR ART
FIG. 1 is a sectional elevational view of a prior art design, indicating a primary seal area in the wellhead with no secondary seal area.
Figure 2:
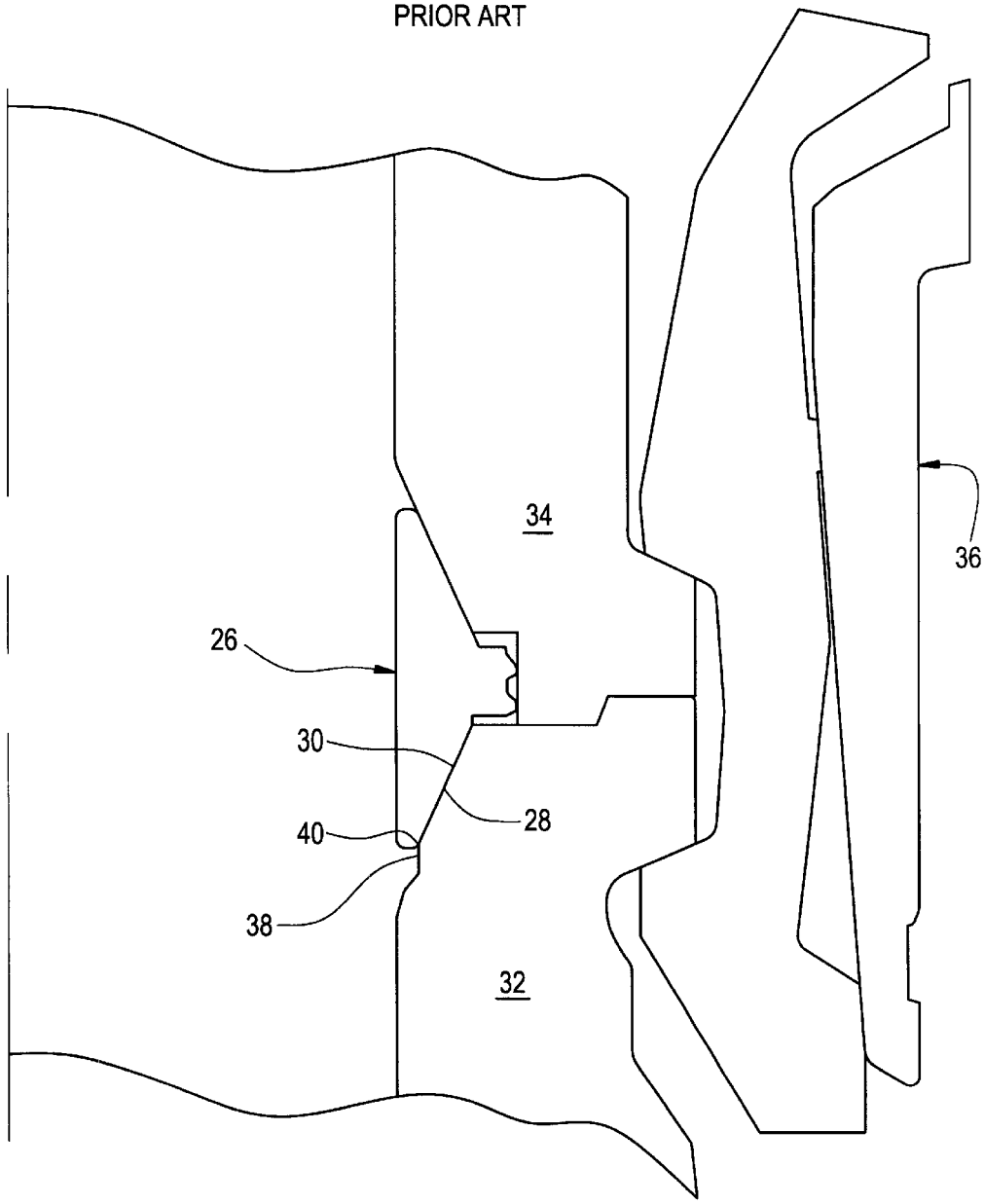
FIG. 2 PRIOR ART
FIG. 2 a sectional elevational view of an alternative prior art design, showing the use of adjacent primary and secondary seal areas operating with the original gasket.
Figure 3:
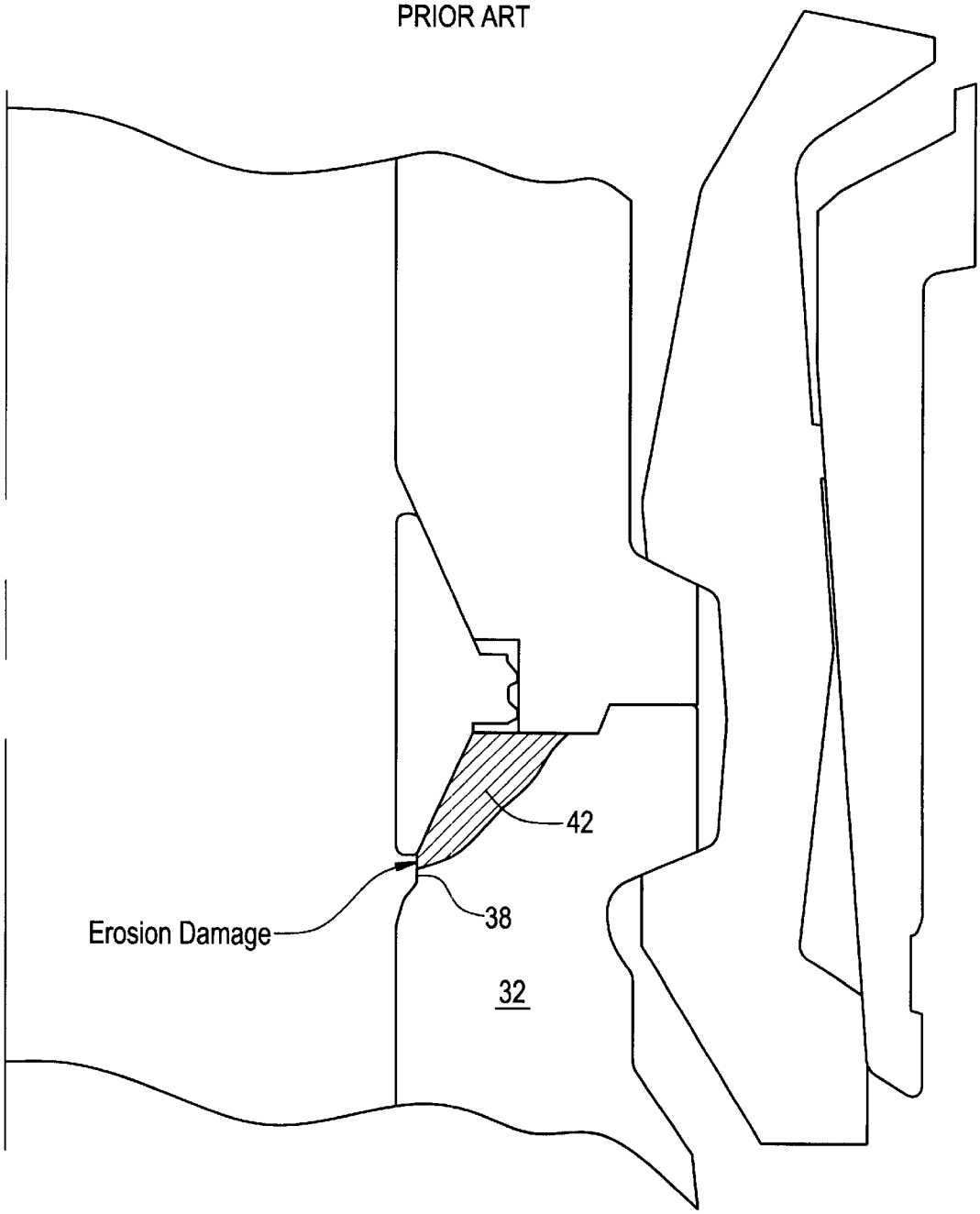
FIG. 3 PRIOR ART
FIG. 3 is the view of FIG. 2, showing the erosive effects of a leak and damage to the secondary seal area.
Figure 4:
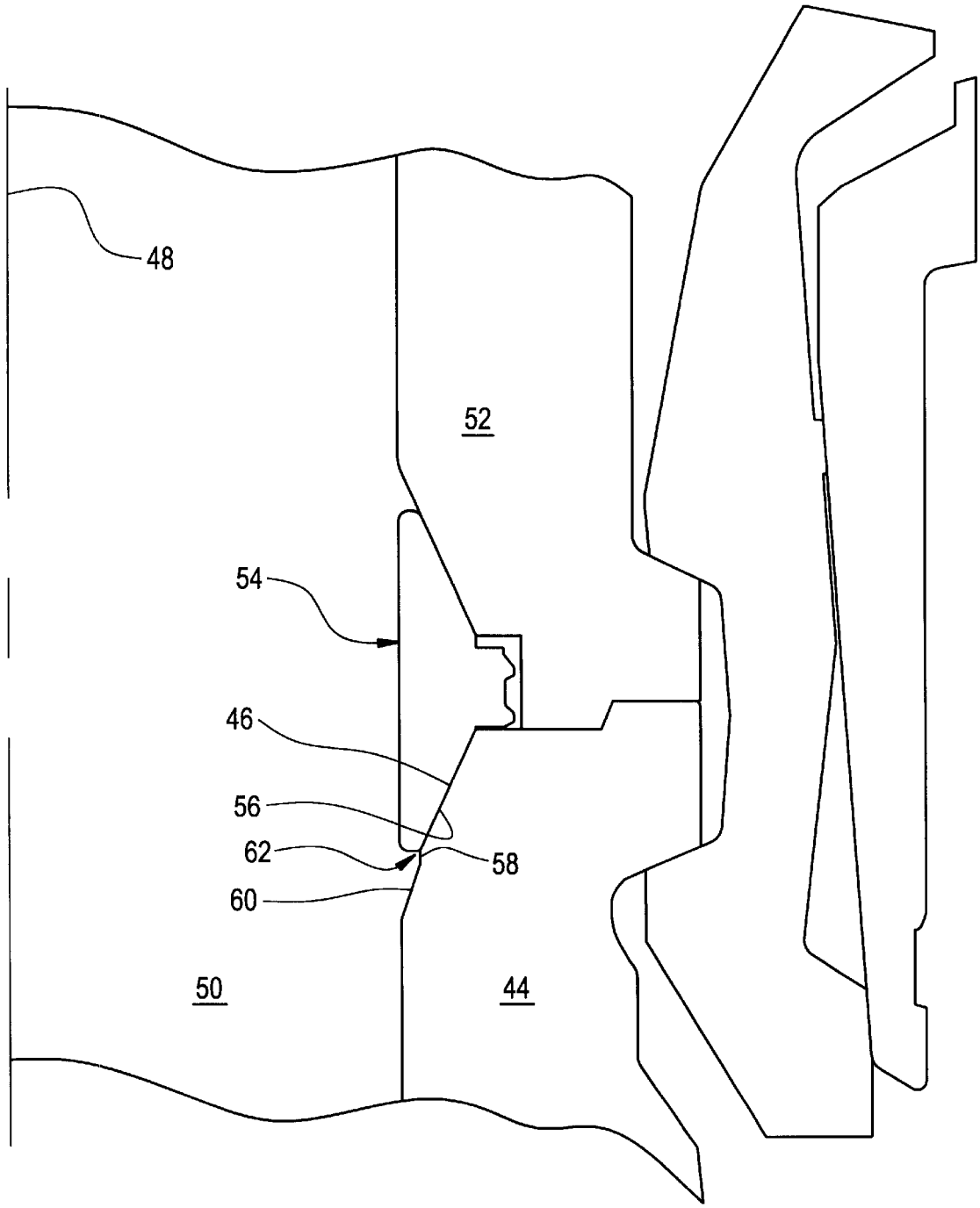
FIG. 4 is a sectional elevational view of the present invention, using a wellhead as the preferred embodiment, illustrating the juxtaposition of the primary and secondary seal areas, with the original gasket installed.
Figure 5:
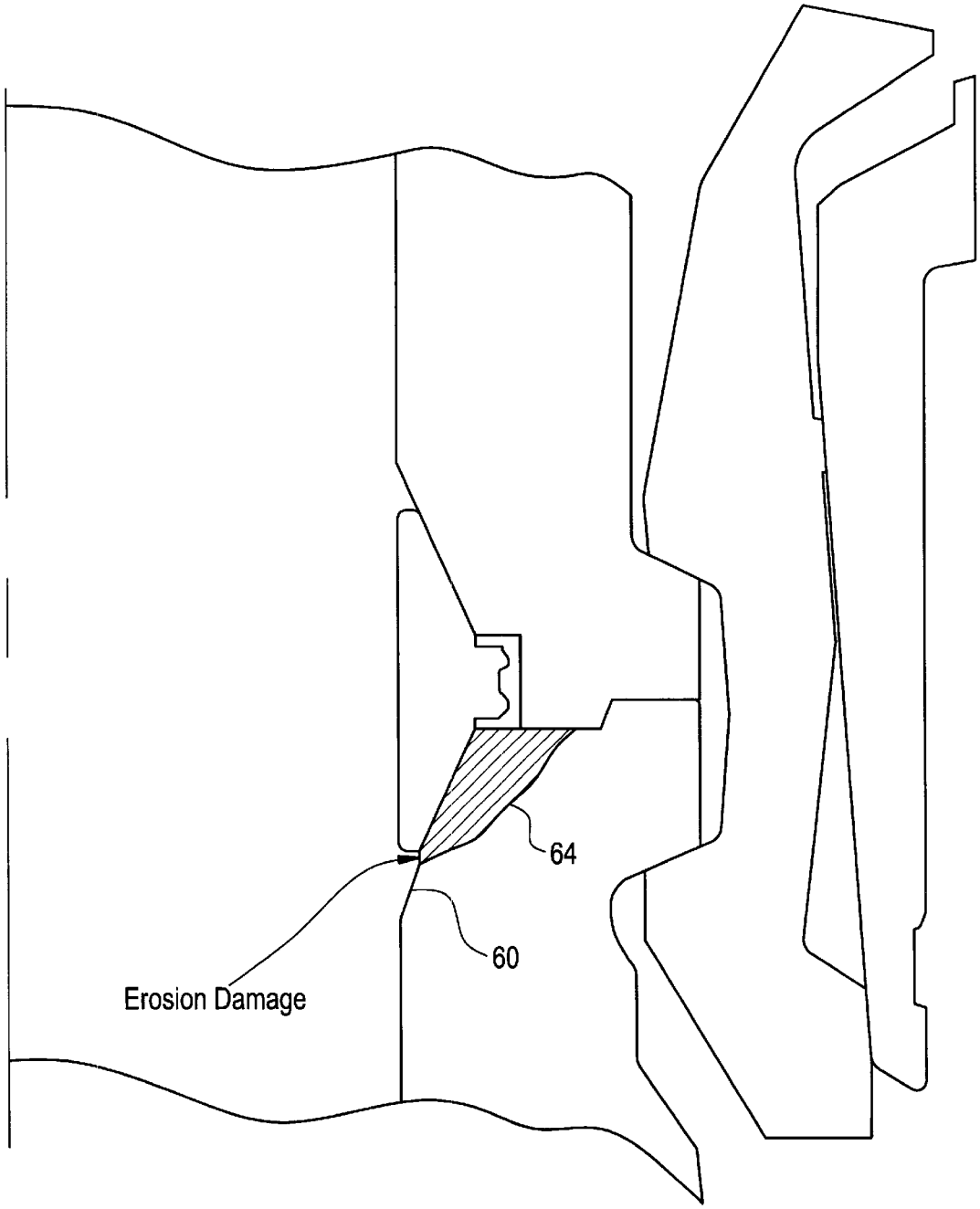
FIG. 5 is the view of FIG. 4, showing that erosion due to a leak has eradicated the primary sealing area and has spread to the transition zone between the primary and secondary sealing areas.

Referring to FIG. 4, the wellhead 44 has a primary sealing surface 46 which is tapered with respect to the longitudinal axis 48 of bore 50, a portion of which is shown in FIG. 4. The connector 52 is mounted above the wellhead 44 and secures the initial gasket 54 to the wellhead 44. Gasket 54 has a tapered surface 56 which conforms to the primary sealing surface 46 to an area just above transition surface 58. Located below transition surface 58 is tapered secondary sealing surface 60. Arrow 62 illustrates how a leakpath begins between primary sealing surface 46 and the conforming tapered surface 56 on gasket 54. As seen in FIG. 5, hatched area 64 illustrates the ravages of erosion as the metal disappears due to high velocity fluid flow past the primary sealing surface 46. The band of material lost expands at its lower end to encompass a significant portion of the transition surface 58. However, as shown in FIG. 5, the tapered secondary sealing surface 60 is unaffected. As further shown in FIG. 6, a contingency gasket 54' can be inserted between the wellhead 44 and the connector 52, which is longer than the original gasket 54 such that it contains tapered surfaces 56' and 66, of which surface 66 conforms to the secondary tapered sealing surface 60. In between is surface 65, which can be radial or sloped and preferably is parallel to surface 58 on the wellhead 44 or the tubular connection on which the invention is used. Thus, the contingency gasket 54' has two sealing surfaces 56' and 66, separated longitudinally by a transition surface 65. If the surface 58 is still intact, then gasket surface 65 has an opportunity to seal against it in conjunction with gasket surface 66 on surface 60. The gasket 54' can have a mirror image of surfaces 56, 66 and 65 at an opposite end, in the preferred embodiment, to allow for a similar sealing effect to, for example, a connector 52.

In the preferred embodiment, the transition surface 58 is cylindrical, but it can have a slight taper and still be within the scope of the invention.

It is the positioning of the secondary sealing surface 60 out of the flowpath of the fast-moving fluid which is escaping through a leak between primary sealing surface 46 and tapered surface 56 of gasket 54 which, in part, protects the secondary sealing surface 60 from the erosive effects of the fastmoving fluid. That physical juxtaposition, coupled with the separation of the primary sealing surface 46 from the secondary sealing surface 60, ensures that, even in the event of failure of the primary seal at surface 46, erosion will not damage the secondary sealing surface 60 so that the contingency gasket 54' can be installed with the knowledge that it will perfect the seal between the wellhead 44 and the connector 52.

Recent developments in the oilfield have dictated that the seal between the wellhead 44 and connector 52 be of metallic construction as opposed to being a resilient seal. One of the reasons for this requirement is that some wells operate at temperatures in excess of 350° F. and at pressures in excess of 12,000 psi. In these conditions, well operators require metal seals. In view of this, many solutions used in the past to repair leaks between the wellhead 44 and the connector 52, which involve resilient seals, cannot be used in these operating conditions.

The interface between the gasket and the sealing area can be damaged in several ways. One way is debris that lands on the sealing area whereupon the connector 52 is locked down on the wellhead 44 through a connection of known design, thus impregnating the sealing surface with debris or leaving a multitude of small dents in the sealing surface. This manifests itself as a slight leak in the first BOP test and has generally in the past been fixed with the use of a resilient gasket between the wellhead 44 and connector 52. Erosion damage of the sealing surface caused by extended flow through a minor leakpath can also damage the sealing surface severely and can erode through the entire hub area of the wellhead 44. When this occurs, a resilient gasket has not been effective to solve the problem. Instead, a bore seal and spacer spool are run into the bore 50 of the wellhead 44 to provide a replacement sealing area for the gasket between the wellhead 44 and the connector 52.

If damage to the primary sealing area, which can be caused by debris or remote-operated vehicle impact or improper wellhead handling, is noticed on the rig, it can be buffed out or the actual wellhead housing replaced. On the other hand, if such a problem is discovered subsea, a resilient seal gasket has been used in the past with some success. It should be noted that the gaskets themselves, if not properly designed, or if the connector 52 is not properly locked to the wellhead 44, or if for some reason the primary sealing surface has been mechanically altered, conditions supporting a leak will be present. In view of the temperature and pressure requirements of well operators and the need to use metal-to-metal seals in those conditions, many of the solutions tried in the past can no longer be used in most installations. It thus becomes more important to be able to configure the sealing areas, both primary 46 and secondary 60, in a configuration where the secondary sealing area will not be damaged due to erosive effects of a leak of the primary sealing area 46.

Figure 6:
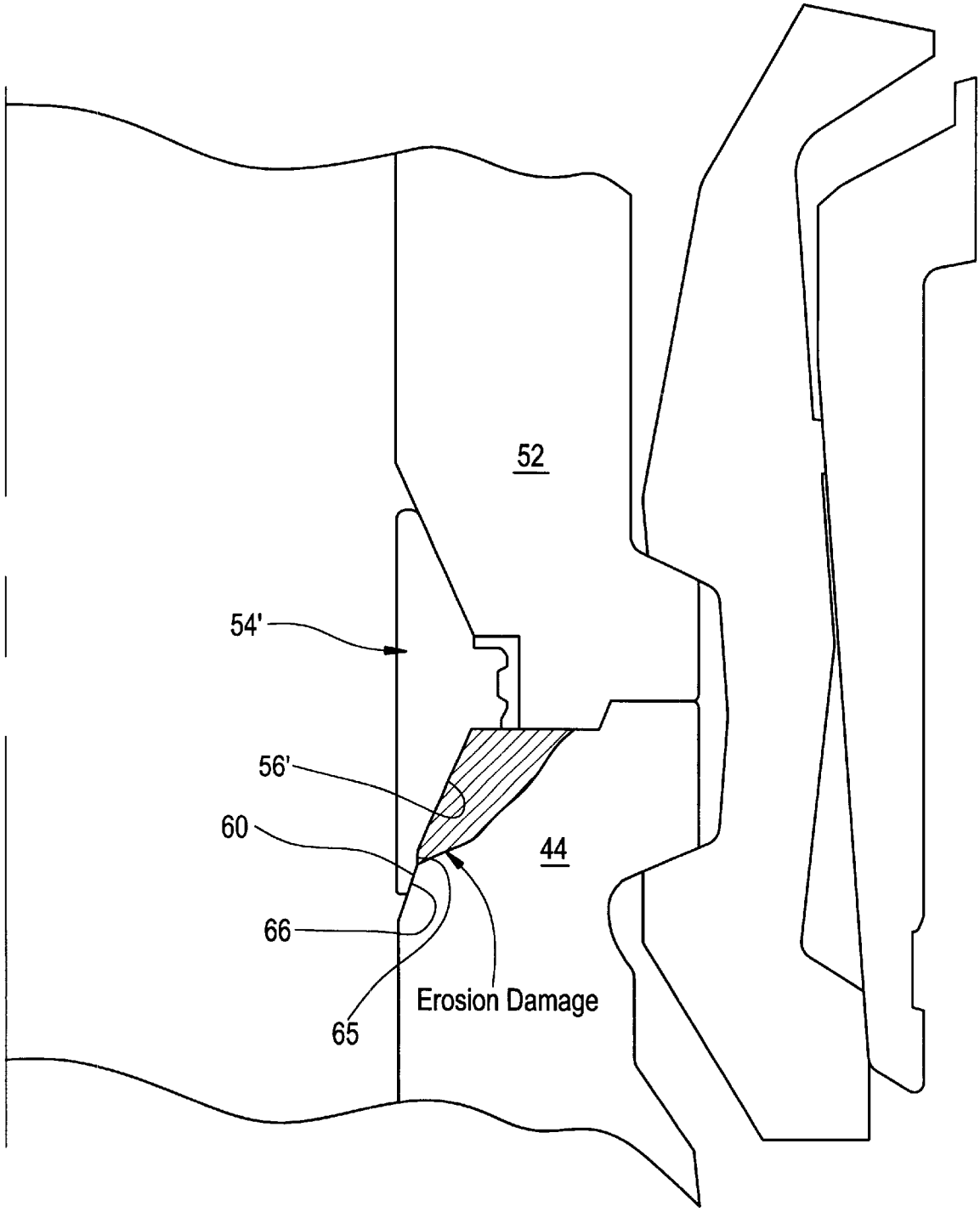
FIG. 6 is the view of FIG. 5, showing the backup or contingency gasket installed and sealingly disposed against the secondary sealing area which is unaffected by the erosion damage.

It should be noted that the configuration shown in FIGS. 4–6 does not require a reduction in the bore size of bore 50, which would be undesirable. Instead, the pressure rating of the wellhead 44 is retained and the secondary sealing area 60 is spaced apart from the primary sealing area 46 and set back so that erosion damage due to a leak, as shown in FIG. 5, will at most damage only the transition area 58 between the primary sealing area 46 and the secondary sealing area 60. The secondary sealing area 60 can be tapered or cylindrical and the taper angle can be less than, equal to, or greater than the taper angle for the primary sealing area 46. Transition area 58 can be cylindrical or tapered. The three distinct areas 46, 58, and 60 can all be tapered, with the transitional area 58 having a different taper angle than area 46. This difference sets back area 60 from exposure to harmful erosive effects of high-velocity fluids if a leak occurs at area 46. The further away that area 60 is placed from area 46, the less likely is area 60 to be damaged by erosion. Stated differently, the longer the separation distance as measured in the longitudinal direction between areas 46 and 60 within limits of the contingency gasket 54' to reach surface 60 and seal effectively, the less likely is surface 60 to be damaged.

The foregoing disclosure and description of the invention are illustrative and explanatory thereof, and various changes in the size, shape and materials, as well as in the details of the illustrated construction, may be made without departing from the spirit of the invention.

What is claimed is:

1. In combination, a tubular connection, capable of accepting different gaskets for primary and secondary sealing, when connecting a first and second members, and at lest one gasket comprising:

a first and second member connectable to each other wherein at least one of said members further comprises a tubular body having a bore along its longitudinal axis and a primary sealing surface and a secondary sealing surface separated by a transition surface, wherein all said surfaces circumscribe said bore;

a secondary gasket usable to seal said first and second members against said secondary sealing surface after said primary sealing surface is no longer functional for effective sealing and mutually exclusive of the primary seal;

a receptacle defined between the members when assembled to each other; and an extending member extending from said gasket and loosely mounted in said receptacle solely to locate said secondary gasket to allow said secondary gasket to make sealing contact with said secondary sealing surface.

2. The connection of claim 1, further comprising:

an initial gasket mountable at least over said primary sealing surface while leaving said secondary sealing surface exposed to said bore for initial operation of said connection.

3. The connection of claim 2, wherein:

said transition surface extends in a generally longitudinal direction for a distance which protects said secondary sealing surface from erosion due to leakage past said initial gasket.

4. The connection of claim 3, wherein:

said transition surface is substantially cylindrical with respect to said longitudinal axis.

5. The connection of claim 3, wherein:

said transition surface is tapered with respect to said longitudinal axis.

6. The connection of claim 3, wherein:

said primary sealing surface is tapered with respect to said longitudinal axis.

7. The connection of claim 6, wherein:

said transition surface is tapered with respect to said longitudinal axis.

8. The connection of claim 7, wherein:

said taper of said transition surface is at a different angle than said primary sealing surface.

9. The connection of claim 3, wherein:

said secondary sealing surface is tapered with respect to said longitudinal axis.

10. The connection of claim 9, wherein:

said transition surface is substantially cylindrical with respect to said longitudinal axis.

11. The connection of claim 10, wherein:

said primary sealing surface is tapered with respect to said longitudinal axis.

12. The connection of claim 11, wherein:

said taper of said primary sealing surface is at a different angle than said taper of said secondary sealing surface.

13. The connection of claim 11, wherein:

said taper of said primary sealing surface is at substantially the same angle as said taper of said secondary sealing surface.

14. The connection of claim 9, further comprising:

said secondary gasket mounted in place of said initial gasket, said secondary gasket having an annular shape and defining three distinct surfaces substantially parallel to said primary, transition, and secondary surfaces of said tubular body;

said tubular body comprises a sub-sea wellhead and said second member of said connection comprises a wellhead connector.

15. The connection of claim 3, wherein:

said secondary sealing surface is substantially cylindrical with respect to said longitudinal axis.

16. The connection of claim 3, further comprising:

said secondary gasket mounted in place of said initial gasket, said secondary gasket engaging at least said secondary sealing surface while spanning over said primary sealing and said transition surface.

17. The connection of claim 16, further comprising:

said secondary gasket contacts said transition and said secondary sealing surfaces.

18. The connection of claim 17, wherein:

said primary sealing surface is tapered with respect to said longitudinal axis.

19. The connection of claim 18, wherein:

said transition surface is substantially cylindrical with respect to said longitudinal axis.

20. The connection of claim 19, wherein:

said taper of said primary sealing surface is at substantially the same angle as said taper of said secondary sealing surface.

21. In combination, a gasket and a tubular connection comprising a first and second tubular wherein at least one of the tubulars has a primary and secondary sealing surfaces and a transition surface between them, said gasket comprising:

an annular shape defining a bore there-through having longitudinal axis and an upper and lower end;

said shape further comprising a sealing surface adjacent to at least one of said upper and lower ends and positioned to engage said secondary sealing surface after said primary sealing surface is no longer functional for effective sealing and the gasket does not engage the transition surface: and said shape further comprising an extending member which is loosely retained between said tubulars, when assembled, said extending member serving solely for location of said shape when said tubulars are assembled together.

22. The gasket of claim 21, wherein:

said shape further comprises a first and second sealing surfaces adjacent at least one of said upper and lower ends, said sealing surfaces separated longitudinally from each other by a transition surface:

said sealing surfaces on said annular shape are disposed transversly to said longitudinal axis.

23. The gasket of claim 22, wherein:

said transition surface on said annular shape is disposed substantially parallel to said longitudinal axis.

24. The gasket of claim 22, wherein:

said transition surface on said annular shape is disposed transverse to said longitudinal axis.

25. The gasket of claim 22, wherein:

said sealing surfaces on said annular shape are at substantially the same angle with respect to said longitudinal axis.

26. The gasket of claim 22, wherein:

said sealing surfaces on said annular shape are at different angles with respect to said longitudinal axis.

27. The gasket of claim 21, wherein:

said shape further comprising a first and second sealing surfaces adjacent at least one of said upper and lower ends, said sealing surfaces separated longitudinally from each other by a transition surface;

said surfaces on said annular shape conform to the sealing and transition surfaces of at least one of the tubulars.

28. The gasket of claim 27, wherein:

said shape further comprising a first and second sealing surfaces adjacent both said upper and lower ends, said pairs of first and second sealing surfaces each separated longitudinally from each other by a transition surface.

29. The gasket of claim 27, wherein:

said transition surface on said annular shape engageable to its conforming surface on one of said tubulars for sealing therewith.

30. The gasket of claim 27, wherein:

said second sealing surface engageable to its conforming surface on one of said tubulars for sealing therewith, even if erosion has destroyed the integrity of sealing surfaces on one of the tubulars that conform to said first and transition surfaces on said annular shape.

31. The gasket of claim 21, wherein:

said shape further comprising a first and second sealing surfaces adjacent at least one of said upper and lower ends, said sealing surfaces separated longitudinally from each other by a transition surface;

said transition surface on said annular shape is disposed transverse to said longitudinal axis.

* * * * *